US008696606B2

(12) United States Patent
Jacofsky et al.

(10) Patent No.: US 8,696,606 B2
(45) Date of Patent: Apr. 15, 2014

(54) PASSIVE MOTION MACHINE WITH INTEGRATED MECHANICAL DVT PROPHYLACTIC THERAPY

(75) Inventors: David Jacofsky, Peoria, AZ (US); Jeffrey Lyman, Scottsdale, AZ (US)

(73) Assignee: Continuous Motionflow, LLC, Phoenix, AZ (US)

( * ) Notice: Subject to any disclaimer, the term of this patent is extended or adjusted under 35 U.S.C. 154(b) by 1117 days.

(21) Appl. No.: 12/586,803

(22) Filed: Sep. 28, 2009

(65) Prior Publication Data

US 2011/0077560 A1 Mar. 31, 2011

(51) Int. Cl.

| | |
|---|---|
| ***A61H 1/00*** | (2006.01) |
| ***A61H 1/02*** | (2006.01) |
| ***A61H 5/00*** | (2006.01) |

(52) U.S. Cl.

USPC ..... 601/29; 601/5; 601/23; 601/27; 601/34; 601/122; 601/124; 601/126

(58) Field of Classification Search

USPC ..... 601/5, 23–24, 26–35, 84–87, 89–95, 601/97–99, 102, 104, 112–113, 115, 118, 601/119, 121, 122, 124, 126

See application file for complete search history.

(56) References Cited

U.S. PATENT DOCUMENTS

| | | | | |
|---|---|---|---|---|
| 4,665,899 | A * | 5/1987 | Farris et al. | 601/33 |
| 4,930,497 | A * | 6/1990 | Saringer | 601/34 |
| 4,974,830 | A | 12/1990 | Genovese et al. | |
| 5,067,479 | A | 11/1991 | Saringer et al. | |
| 5,211,161 | A * | 5/1993 | Stef | 601/5 |
| 5,280,783 | A | 1/1994 | Focht et al. | |
| 5,738,636 | A | 4/1998 | Saringer et al. | |
| 5,951,499 | A | 9/1999 | Saringer et al. | |
| 6,010,468 | A | 1/2000 | Grove et al. | |
| 6,210,349 | B1 | 4/2001 | Naruse et al. | |
| 6,290,662 | B1 | 9/2001 | Morris et al. | |
| 6,840,914 | B1 | 1/2005 | Takamura | |
| 7,081,098 | B2 * | 7/2006 | Kim | 601/18 |
| 7,090,650 | B2 | 8/2006 | Ou et al. | |
| 7,108,664 | B2 | 9/2006 | Mason et al. | |
| 7,175,602 | B2 | 2/2007 | Diaz et al. | |
| 7,192,406 | B2 * | 3/2007 | Marten | 601/127 |
| 2002/0022791 | A1 | 2/2002 | Morris et al. | |
| 2003/0225351 | A1 | 12/2003 | Wu | |

(Continued)

OTHER PUBLICATIONS www.footcaresales.com/shop/upload/anti-dvt-products/eat_17.html, Apr. 10, 2008.

(Continued)

*Primary Examiner* — Justine Yu
*Assistant Examiner* — Colin W Stuart
(74) *Attorney, Agent, or Firm* — Ballard Spahr LLP

(57) ABSTRACT

There is provided a continuous passive motion (CPM) machine with integrated mechanical deep vein thrombosis (DVT) prophylaxis for providing simultaneous CPM therapy and DVT prophylactic therapy to a human patient. The passive motion machine may include a base, at least one motor, one or more hinged frame rails, one or more support or suspension structures and a roller assembly. The hinged frame rails are driven to impart CPM to a patient's limb. The roller assembly can be a single roller, a multiple roller unit, or a belt and roller apparatus. A motor and connecting drive rotates the roller assembly. The roller assembly engages the patient's limb and the one or more rollers apply a mechanical DVT prophylaxis therapy to the limb, reducing the risk of blood clotting.

28 Claims, 13 Drawing Sheets

(56) References Cited

U.S. PATENT DOCUMENTS

| | | | | |
|---|---|---|---|---|
| 2004/0073146 | A1 | 4/2004 | Weintraub et al. | |
| 2004/0077978 | A1 | 4/2004 | Nelson et al. | |
| 2004/0186399 | A1 | 9/2004 | Tseng | |
| 2005/0010145 | A1* | 1/2005 | Fenkell | 601/99 |
| 2005/0090769 | A1* | 4/2005 | Chen | 601/99 |
| 2005/0251067 | A1 | 11/2005 | Terry | |
| 2005/0277856 | A1 | 12/2005 | Munro | |
| 2006/0074362 | A1 | 4/2006 | Rousso et al. | |
| 2006/0085047 | A1 | 4/2006 | Unsworth et al. | |
| 2007/0232969 | A1* | 10/2007 | Yu | 601/99 |
| 2007/0238587 | A1 | 10/2007 | Darben | |
| 2008/0015630 | A1 | 1/2008 | Rousso | |
| 2008/0021531 | A1 | 1/2008 | Kane et al. | |
| 2008/0026350 | A1 | 1/2008 | Yacoubian | |
| 2008/0058911 | A1 | 3/2008 | Parish et al. | |
| 2009/0112137 | A1* | 4/2009 | Lamore | 601/112 |
| 2010/0286578 | A1* | 11/2010 | Lee | 601/115 |
| 2011/0137218 | A1* | 6/2011 | Collins | 601/118 |

OTHER PUBLICATIONS

Alford, et al. Design for Continuous Passive Motion Lumbar Support Roller, Biomedical Engineering Design 200/300, University of Wisconsin—Madison, Dec. 14, 2001.

* cited by examiner

PASSIVE MOTION MACHINE WITH INTEGRATED MECHANICAL DVT PROPHYLACTIC THERAPY

FIELD OF THE INVENTION

The present invention relates to medical devices. More particularly the present invention relates to a passive motion machine with integrated mechanical deep vein thrombosis (DVT) prophylactic therapy.

BACKGROUND OF THE INVENTION

It is estimated that more than a million joint replacement surgeries are performed each year worldwide. It is further estimated that that number will double in the next ten or twenty years. While joint replacement surgeries are common and generally very successful, they are not without risk. Frequent complications include loosening of the implant, infection and deep vein thrombosis (DVT).

DVT affects millions of people each year. DVT occurs when blood cells coagulate within a deep vein. Once a DVT occurs, portions of the clot can break free and move through the bloodstream to the lungs or brain. A clot that lodges in the lungs may block blood flow within the lungs, causing a potentially fatal pulmonary embolism. A blood clot that reaches the brain may cause a stroke. As many as 200,000 people die each year as the result of complications from DVT.

A post-operative joint replacement patient is at the highest risk of developing a DVT approximately ten to twelve days after surgery. At that point, the large majority of patients are being cared for on an outpatient basis. To prevent the formation of DVT, and avoid the risks associated with DVT, doctors generally prescribe one or more forms of DVT prophylaxis, which include primarily chemical and mechanical DVT prophylactic therapies. While each of these therapies is beneficial in some respect, each suffers significant shortcomings.

Common types of chemical DVT prophylaxis include drugs such as warfarin and heparin, which are used to prevent the patient's blood cells from adhering and forming clots. These drugs work by effectively preventing the formation of certain proteins that are needed for blood to clot. While they are effective, they are also very dangerous. The treatment leaves patients at high risk for various potentially fatal bleeding problems including, but not limited to, gastrointestinal bleeding and brain hemorrhage. Further, a number of patients are advised not to use anticoagulants due to various other conditions that create increased risk of fatality. Hence, there is a need for effective non-chemical DVT prophylaxis.

The most common mechanical DVT prophylactic therapy, device is a pneumatic sleeve, which consists primarily of a flexible plastic envelope that encloses a portion of a limb—generally a lower limb. The envelope is periodically inflated to create pressure against the tissues of the limb. The periodic compression and release of the tissues serves to facilitate blood and fluid exchange. When the pneumatic pressure within the envelope increases, the tissues are compressed and a portion of blood and other fluids in the limb are forced out through the circulatory and lymphatic pathways. When the envelope is deflated the limb is free to fill with fluid unimpeded. This method of providing mechanical compression increases the overall velocity of venous flow. Additional means of providing mechanical compression include stockings, compression straps, massage and vibrations, each of which is also designed to increase circulation and fluid exchange.

Mechanical DVT prophylaxis is beneficial in that it physically aides movement of blood and other fluids. Additionally, it is believed to have a wider systemic effect, likely due to the release of various anti-clotting factors during endothelial compression. However, existing means of mechanical compression are enormously imperfect. Circulation in the lower limbs is predicated on the function of one-way valves in the large veins. Currently used devices, such as compression stockings and pneumatic sleeves, attempt to cause movement of fluid in the limb by creating non-directional mechanical compression of the tissues. However, because this compression is non-directional, it simply creates pressure against which blood must be pumped on its way from the distal end of the extremity back towards the torso. This type of non-directional mechanical compression is very inefficient. Accordingly, there is a need for a device that causes directional mechanical compression of the lower limb, oriented such that the compression pushes blood up the limb and back towards the heart, effectively aiding the one-way valves of the leg.

In addition to being an inferior method for increasing venous flow, existing methods of providing mechanical DVT prophylaxis are cumbersome and difficult to maneuver. For example, pneumatic compression sleeves consist of various fasteners, tubes, electrical cords and a machine. Post-operative patients are generally taking significant pain medications, experiencing very limited mobility, and are often elderly. The equipment for providing mechanical DVT prophylaxis creates an additional hazard for these patients, and as such, doctors hesitate to send patients home with such a device. Accordingly, patients often do not receive adequate DVT prophylaxis during the critical ten to twelve day period. Hence, there is an additional need for a system that is simple and portable such that it is practical for use both in a treatment facility and at home.

In addition to preventing formation of DVT and other risks associated with joint replacement, doctors generally prescribe a physical therapy regimen to aide the patient's functional recovery.

Continuous passive motion (CPM) machines are used regularly in orthopedics and physical therapy. These machines are most often used after surgical procedures, such as joint replacement. The machine moves a patient's limb through a predetermined range of motion without physical exertion by the patient. The passive movement of the affected limb has several positive effects. First, CPM helps to prevent the adhesion of superficial tissues to deeper tissues during healing. These adhesions, if developed, can limit the range of motion of the joint and therefore limit the functional recovery of the patient. Second, CPM serves to stretch the tissues around the joint to maximize flexibility and prevent healing of tissues with stiff fibrous connections that further limit mobility.

Often, when a post-operative joint replacement patient is discharged from the hospital, the doctor prescribes a CPM regimen, to be performed on an outpatient basis. A CPM machine is generally purchased or rented from one of a variety of companies. Medicare covers the cost of renting a CPM machine for the prescribed period of time following some joint replacement surgeries.

In view of the foregoing, there is a need to provide a more effective system for providing mechanical DVT prophylaxis, both within the treatment facility and at home, particularly ten to twelve days after surgery. An ideal device would be portable and simple to use such that it can be used safely on an outpatient basis. The system should provide directional compression such that it effectively aides movement of the blood from a distal position back towards the heart. Further, the mechanical DVT prophylactic therapy is preferably provided in combination with CPM therapy because the simultaneous provision of CPM and mechanical DVT prophylaxis is likely to provide enhanced synergistic effects such as enhanced venous flow during CPM that likely serves to further reduce the risk of DVT formation, and increased blood supply to the damaged tissue during DVT prophylaxis that may serve to increase the rate of healing and enhance the ability to fight infection. Finally, the therapies are ideally provided in combination because such an arrangement is cost effective for the large number of patients on Medicare. The present invention addresses one or more of these needs.

SUMMARY OF THE INVENTION

In accordance with one aspect of the present invention, and by way of example only, there is provided a passive motion machine with integrated deep vein thrombosis prophylactic therapy for use by or on a human patient. The passive motion machine may include a base, one or more motors, one or more hinged frame rails for imparting passive motion, a roller assembly, and a suspension structure or support structure for positioning the roller assembly in proximity to the hinged frame rails for contact with a patient's limb. The one or more motors provide the passive motion to the limb and rotate the roller assembly against the limb.

In one embodiment the suspension structure positions the roller assembly in proximity to the hinged frame rails for contact with a patient's limb by suspending the roller assembly from the hinged frame rails. In another embodiment of the invention, the support structure, which is affixed to the base of the machine, positions the roller assembly in proximity to the hinged frame rails for contact with a patient's limb by supporting the roller assembly from the base.

According to one embodiment of the present invention, the roller assembly has a single roller. According to another embodiment, the roller assembly is a multiple roller unit. In a further embodiment, the roller assembly is a belt and roller apparatus. The roller assembly preferably includes one or more hubs supporting the roller or rollers for rotation.

As the one or more rollers of the roller assembly contact the patient's limb, both the roller assembly and the one or more rollers roll on the patient's limb. The one or more rollers apply a mechanical DVT prophylaxis therapy to the patient's limb, reducing the risk of blood clotting. Each roller may have a symmetrical or asymmetrical contour along its length. Further, each individual roller may have surface structures, such as bumps, ridges and the like.

Preferably, rotation is imparted to the roller assembly so that the roller assembly rotates in a direction that presses fluid from the distal end of the limb towards the torso. Rotation may be imparted to the roller assembly by a motor driven gear drive, belt drive, direct drive or transmission. The motor may be the same motor that drives the passive motion machine or it may be a separate motor driving just the roller assembly.

The CPM machine may include one or more limb supports for supporting the affected limb from the hinged frame rails for CPM. The limb supports may include a sling and/or a foot rest.

In one embodiment of the invention a vascular monitor system is employed in a feedback loop supplying vascular flow information to a controller for the motor driving the roller assembly.

Other independent features and advantages of the continuous passive motion device will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention. Reference will now be made in detail to exemplary embodiments of the invention, examples of which are illustrated in the accompanying drawings. Wherever possible, the same reference numbers will be used throughout the drawings to refer to the same or like parts.

Figure 1:
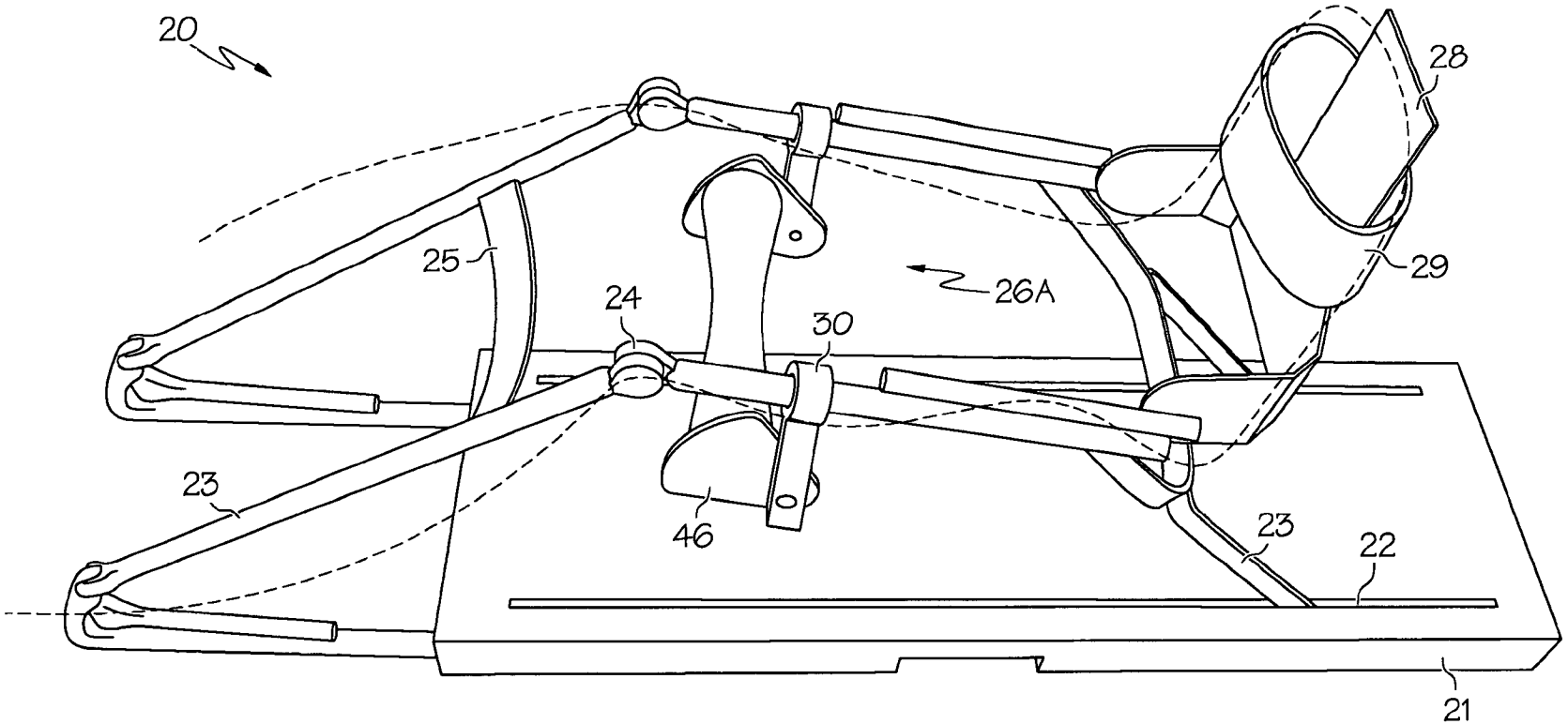
FIG. 1 is a perspective view of a CPM machine with integrated DVT prophylactic therapy, wherein the roller assembly, a single roller unit, is suspended from the hinged frame rails, according to an embodiment of the present invention.
Figure 2:
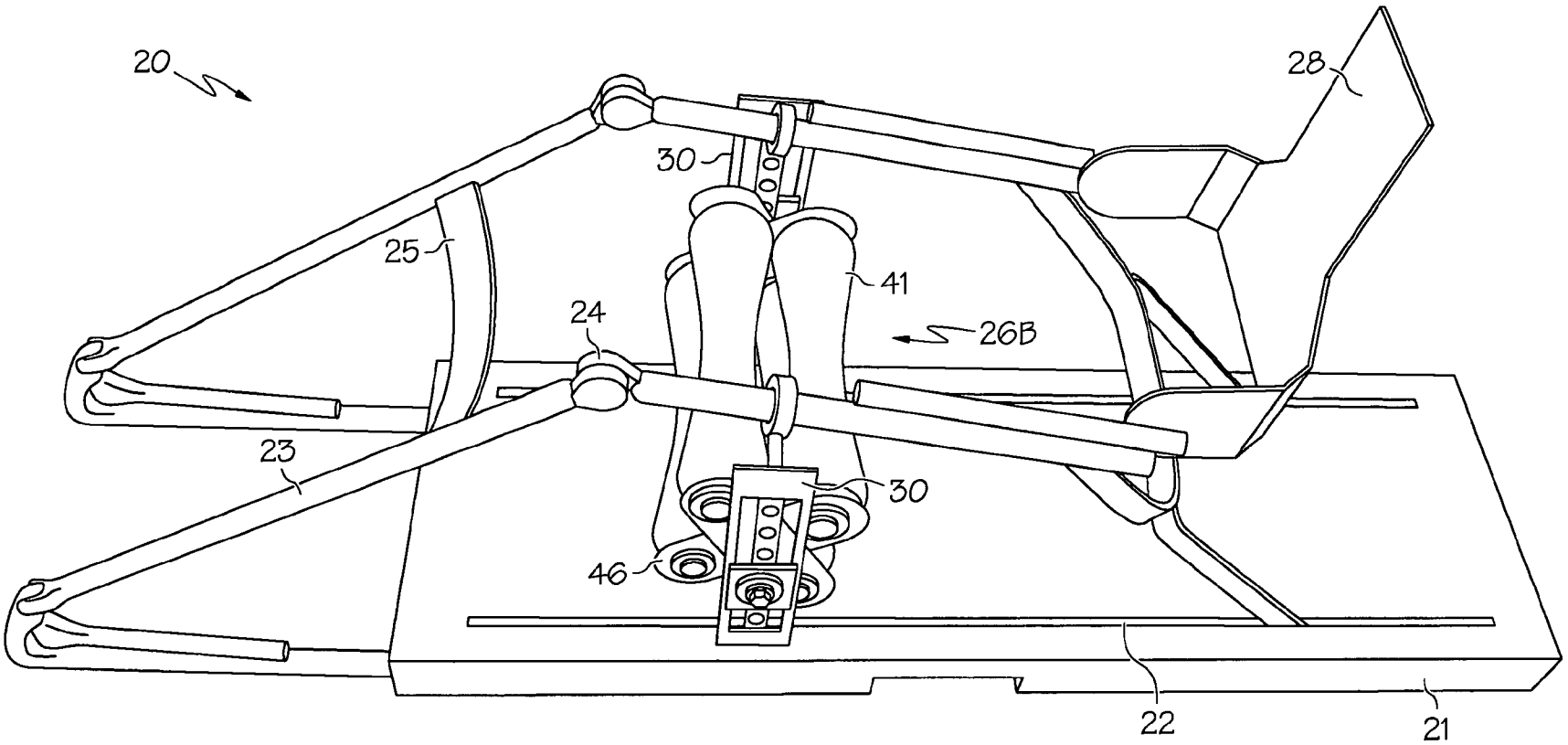
FIG. 2 is a perspective view of a CPM machine with integrated DVT prophylactic therapy, wherein the roller assembly, here a multiple roller unit, is suspended from the hinged frame rails, according to another embodiment of the present invention.
Figure 3:
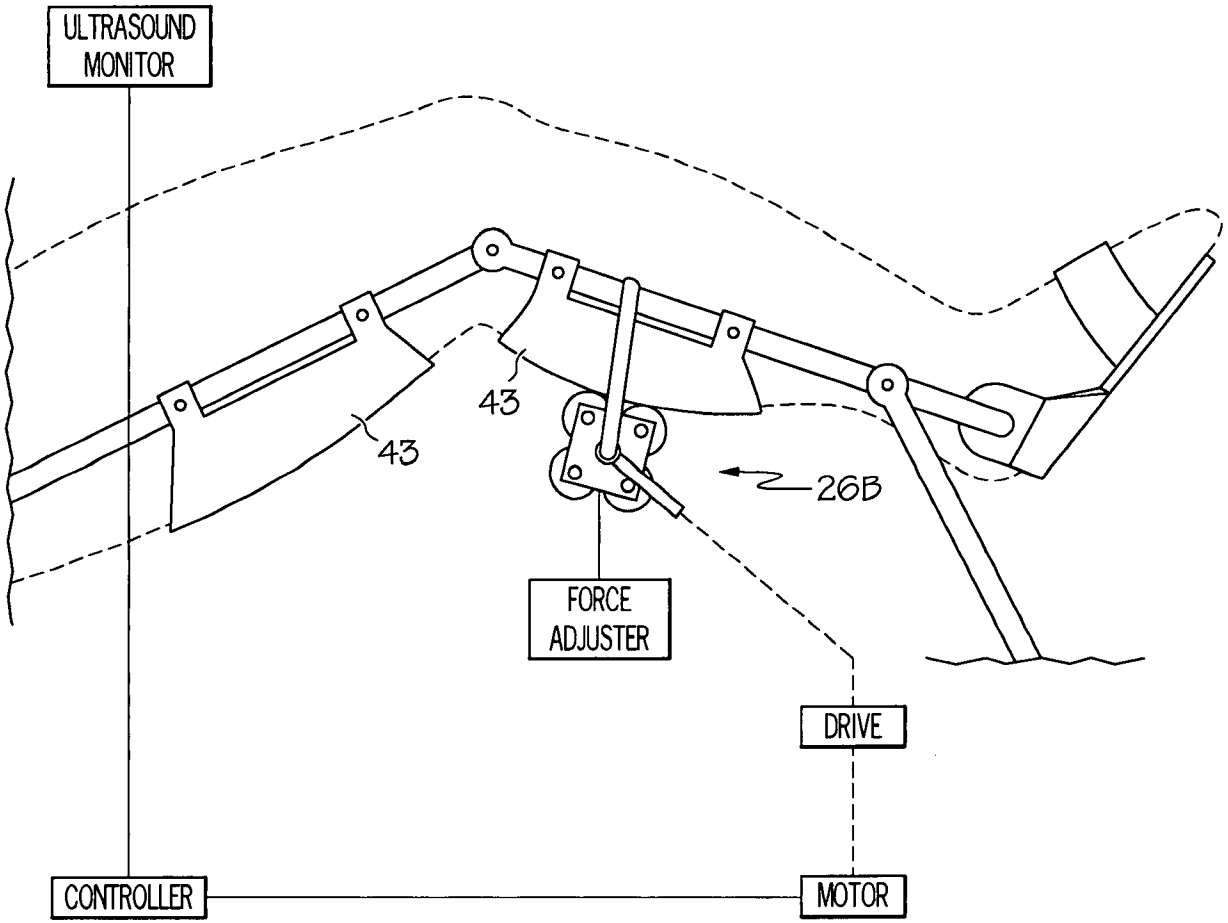
FIG. 3 is a perspective view of a CPM machine with integrated DVT prophylactic therapy, and includes a schematic representation of a motor, a driver for rotating the roller assembly, a force adjuster, a vascular monitor, and a controller, according to an embodiment of the present invention.
Figure 10:
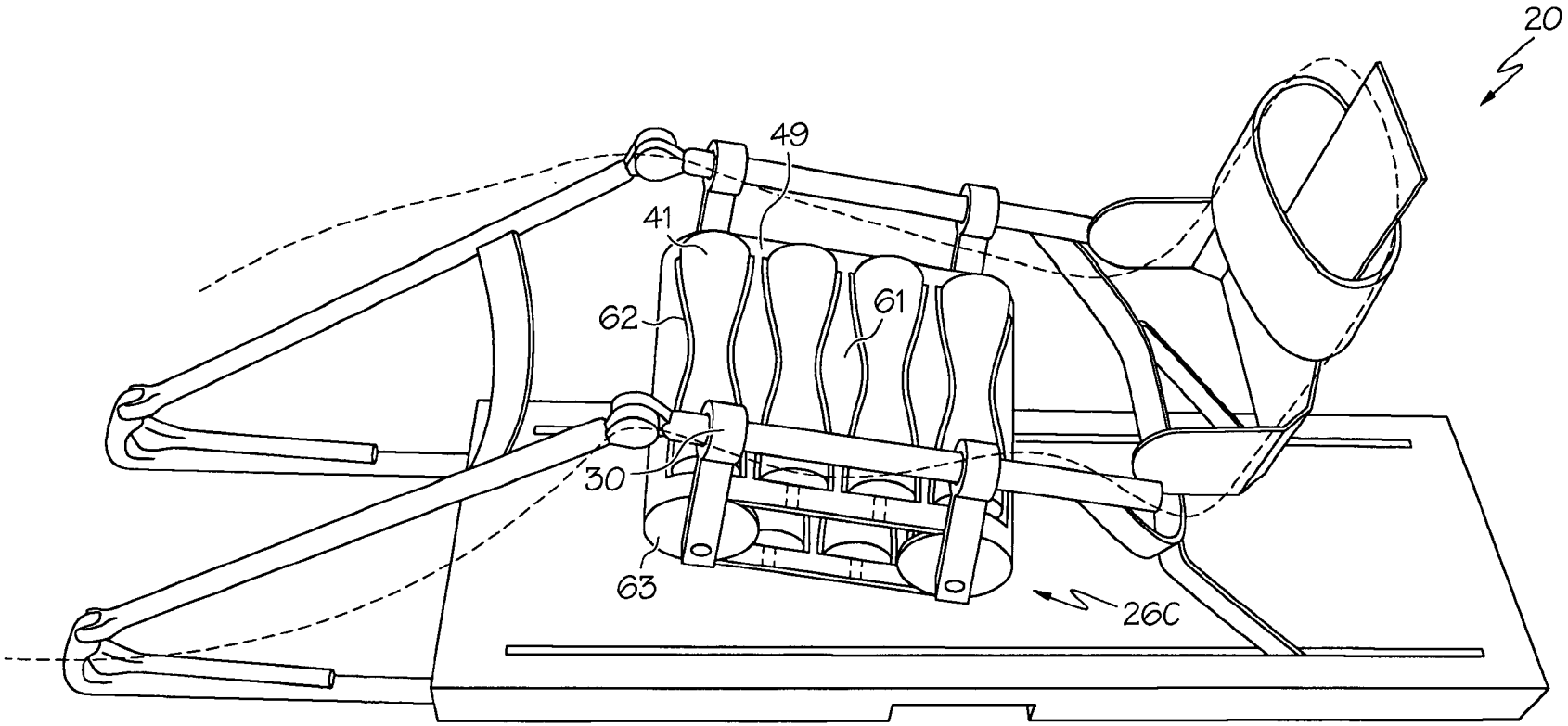
FIG. 10 is a perspective view of a CPM machine with integrated DVT prophylactic therapy, having a roller assembly that is a belt and roller apparatus, according to another embodiment of the invention.

Referring initially to FIGS. 1 and 2 there is shown preferred embodiments of a continuous passive motion machine 20 with integrated DVT prophylactic therapy. In each, the device includes a base 21, at least one motor (not pictured in FIGS. 1 and 2), one or more hinged frame rails 23, one or more limb supports 25, and a roller assembly 26. The roller assembly 26 may be a single roller assembly as shown in FIG. 1 and designated 26A, it may be a multiple roller unit roller assembly as shown in FIG. 2 and designated 26B, or it may be a belt and roller apparatus as shown in FIG. 10 and designated 26C. The base 21 provides a platform on which the device 20 rests. The motor that drives the one or more hinged frame rails 23 is contained within the base 21. Conventionally, the one or more hinged frame rails 23 are operably connected to the motor within base 21. The motor that drives the one or more hinged frame rails 23 may also operate the roller assembly 26 for DVT prophylactic therapy, or as shown schematically in FIG. 3, a separate motor 27 may operate the roller assembly as described in greater detail below. The one or more hinged frame rails 23 protrude from the base 21 through one or more slits 22 in the surface of base 21. And as understood in the art, the one or more hinged frame rails 23 may be set into a continuous motion so as to gently flex the patient's knee joint as part of a therapeutic treatment. As is further understood by those skilled in the art, the one or more hinged frame rails 23 are hinged at hinges 24 in order that the motor within base 21 and control machinery can move the one or more hinged frame rails 23 so as to move the joint through the predetermined portion of its range of motion. Though two hinged frame rails 23 are show, use of one hinged frame rail 23 is within the inventive concept and may be preferable in some embodiments. The one or more limb supports 25 are positioned between the one or more hinged frame rails 23 and connected to the one or more hinged frame rails 23 such that the patient's limb is adequately supported. The limb support 25 may include a foot support 28 and one or more straps 29 as shown in FIG. 1. The limb support 25 may also include a conformable sling 43 as shown in FIG. 3. The roller assembly 26 is connected to the device 20 using one or more suspension structures 30 or one or more support structures 35 for positioning the roller assembly 26 in proximity to the one or more hinged frame rails 23 for contact with the patient's limb. The suspension structure 30 may connect the roller assembly 26 to the device 20 at the one or more hinged frame rails 23, as shown by way of example in FIGS. 1, 2, 3 and 4. Additionally or alternatively, a support structure 35 may connect the roller assembly 26 to the device 20 at the base 21, as shown by way of example in FIGS. 5 and 7. The roller assembly 26 provides the desired directional mechanical DVT prophylaxis. Thus, the machine contemplated provides a combination therapy that includes passive joint motion as well as mechanical DVT prophylaxis.

Figure 4:
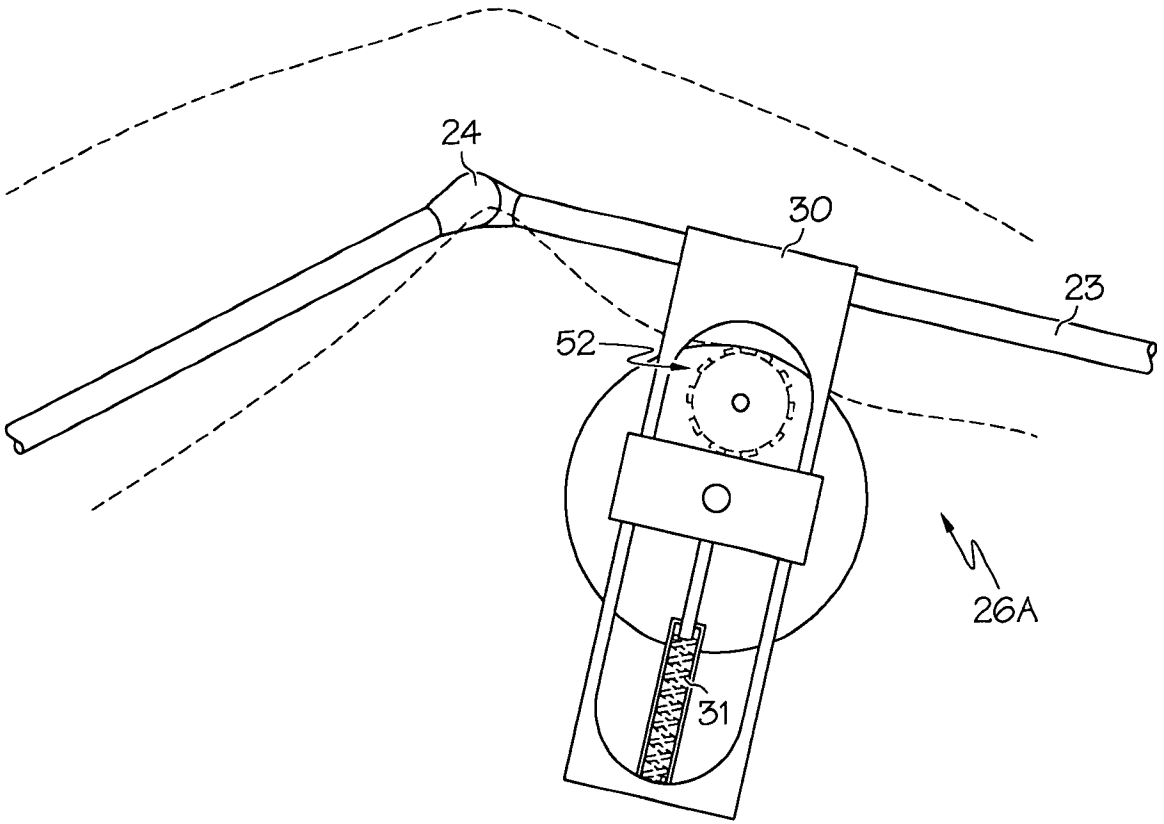
FIG. 4 is a enlarged fragmentary side view of a roller assembly and suspension element, for use in a CPM machine with integrated DVT prophylactic therapy, according to one embodiment of the present invention.

Referring to FIGS. 1, 2 and 4, the roller assembly 26 may be connected to the one or more hinged frame rails 23 and supported for contact with the patient's limb by one or more suspension structures 30. The suspension structure 30 may comprise any system that moveably or fixedly secures the roller assembly 26 to the one or more hinged frame rails 23. Preferably the suspension structure 30 is adjustable, as shown in FIG. 2, such that the user may change the position of the roller assembly 26 with respect to the one or more hinged frame rails 23 to account for the varying sizes of patients and limbs. As shown in FIG. 4, the suspension structure 30 may comprise a spring 31 or other linear elastic component such that the pressure of the roller assembly 26 against the patient's limb is not governed entirely by the weight of the limb. The suspension structure 30 may further be a simple non-adjustable structure as shown in FIG. 1.

Figure 5:
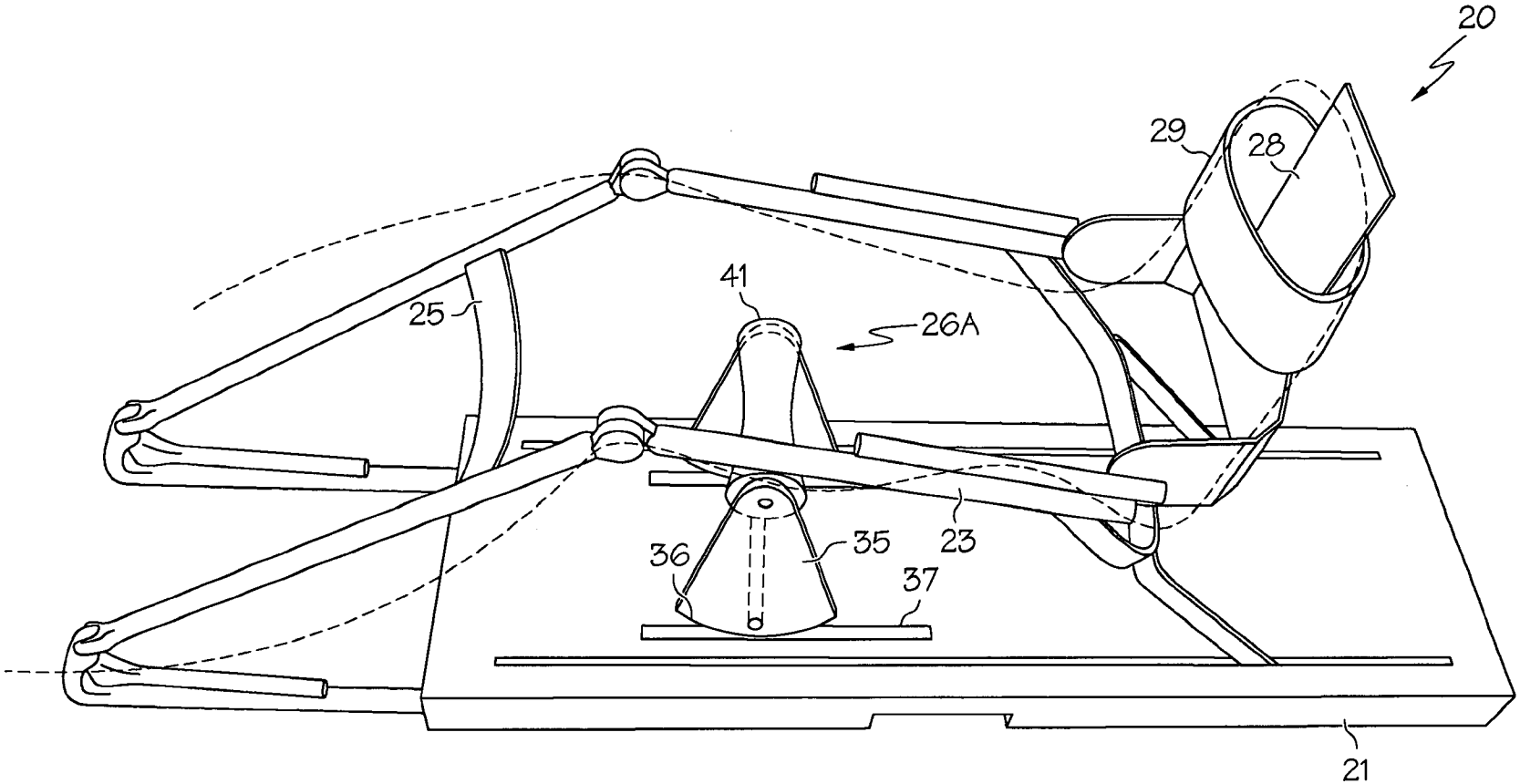
FIG. 5 is a perspective view of a CPM machine with integrated DVT prophylactic therapy, wherein the roller assembly, here a single roller, is supported on the base according to still another embodiment of the present invention.
Figure 6:
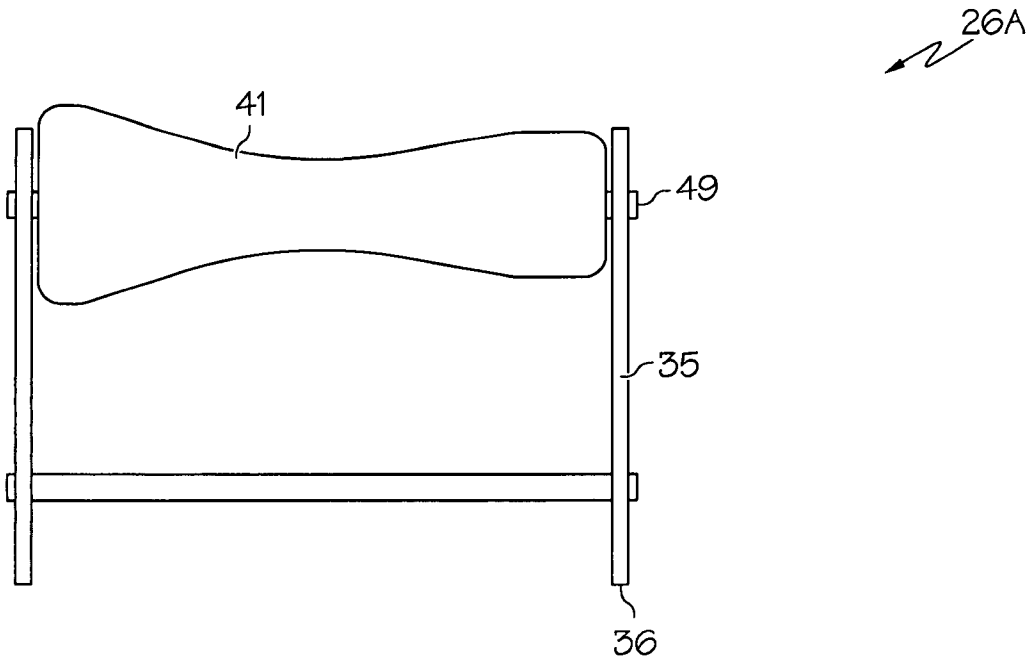
FIG. 6 is an enlarged fragmentary end view of a roller assembly comprising a single roller with asymmetric contour, according to an embodiment of the present invention.
Figure 7:
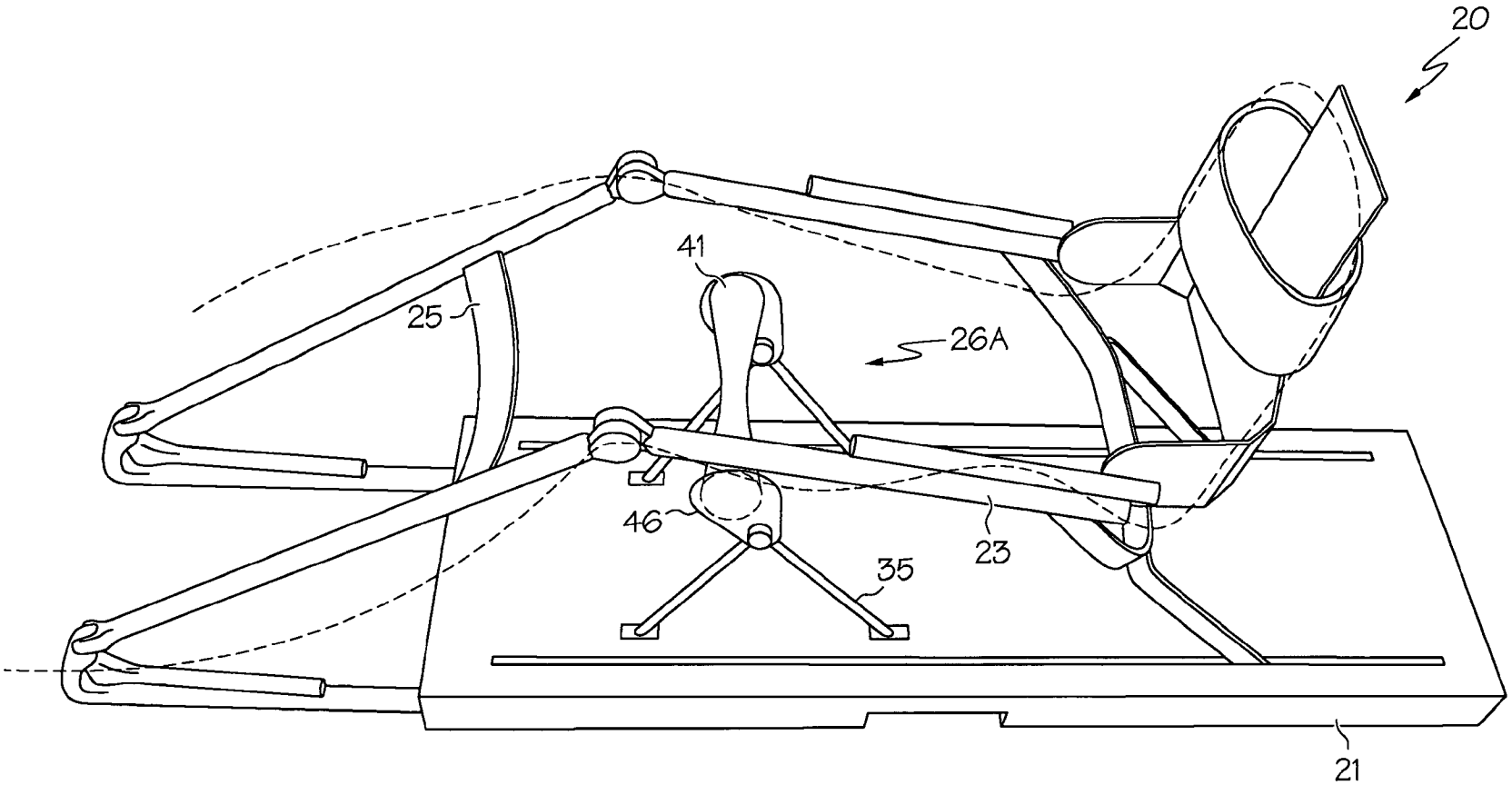
FIG. 7 is a perspective view of a CPM machine with integrated DVT prophylactic therapy, wherein the roller assembly, here a single roller, is supported on the base according to yet another embodiment of the present invention.

Alternatively, as depicted in FIGS. 5, 6 and 7, the roller assembly 26 may be positioned in proximity to the one or more hinged frame rails 23 for contact with the patient's limb, by one or more support structures 35 connected to the base 21. The support structure 35 may be a simple rigid support, such a the rigid A-frame support shown in FIG. 7, it may include a spring 31 like the spring of FIG. 4, it may include an arcuate base 36 (best shown in FIG. 5), or the like. Any component designed to support the roller assembly 26 above the surface of the base 21 is within the inventive concept. The parameters of the support structure 35, including height, width, the arc of the base, etc., are chosen such that the roller assembly 26 contacts the desired portion of the patient's limb while the device 20 is providing CPM without interfering with movement of the one or more hinged frame rails 23. Preferably, the position of the roller assembly 26 with respect to the base 21 is adjustable to account for the varying size of patients and limbs.

Figure 8:
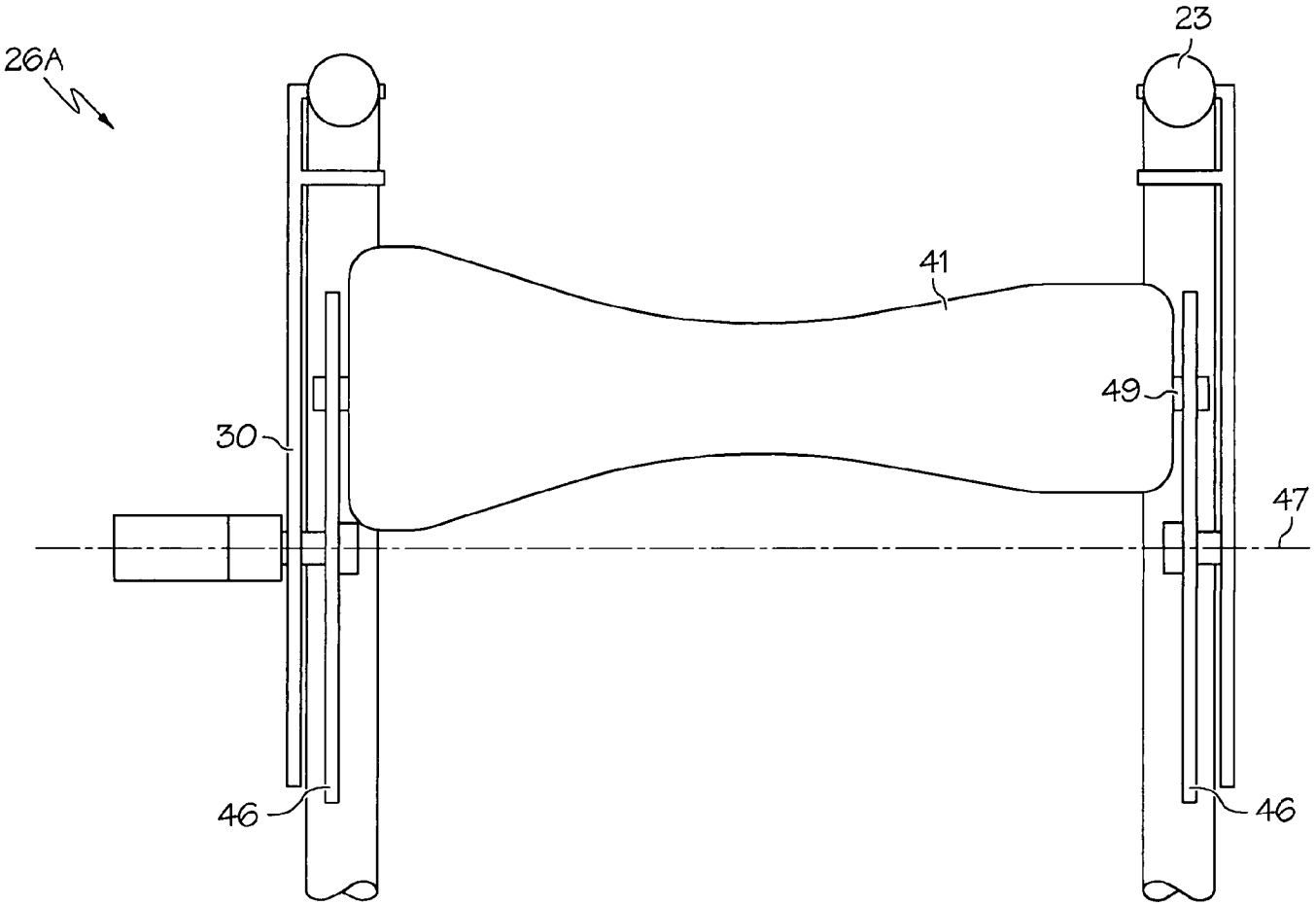
FIG. 8 is an enlarged fragmentary end view of a roller assembly, here a single roller, according to an embodiment of the present invention.

According to the embodiment shown in FIG. 8, the roller assembly 26 is a single roller structure 26A, which has just one roller 41. The roller 41 may include a central cylindrical aperture 42 at each end (visible in FIG. 13) such that the roller 41 may be rotatably secured to the suspension structures 30 by pins or other suitable fasteners 49 (visible in FIG. 11). Other means of supporting the roller 41 may be chosen, such as a single, central axial bore accommodating a rod extending axially through the roller to support it for rotation. The single roller 41 is preferably positioned a distance away from the center of rotation 47 of the roller assembly 26A. This off-center single roller embodiment can be achieved, for example, using hubs 46 located on either end of the roller 41. The hubs 46 are further rotatively attached to the suspension structures 30. The roller 41 may be positioned at a location with respect to the hubs that is radially outward from the roller assembly's center of rotation 47 extending from the center of one hub 46 to the center of another hub 46. This embodiment provides for intermittent periods of contact and noncontact between the roller 41 and the limb. Conceivably, the off-center position of the roller 41 could be accomplished as well using just one hub to rotatively support the roller 41 in cantilever fashion.

Less desirable, but still within the inventive concept, is an embodiment wherein the single roller 41 is positioned at the center of rotation of the single roller roller assembly 26A. In this embodiment, the roller 41 is preferably free to rotate with respect to the one or more suspension structures 30. During use, this embodiment provides constant contact between the roller 41 and the limb.

Alternatively, the single roller 41 may be attached to one or more support structures 35 that are further attached to or supported upon the base 21, as shown by way of example in FIGS. 5, 6 and 7. The support structures 35 may include a generally arcuate base 36 that allows the roller assembly 26 to rock backwards and forwards, which further causes the roller 41 to move with respect to the limb. Alternatively the support structures 35 may include a single rigid support or a rigid A-frame support (shown in FIG. 7) for positioning the roller assembly in proximity to the patient's limb. The one or more support structures 35 may be either moveably or fixedly attached to the base 21 and the roller assembly 26 to prevent unintended movement of the one or more support structures 35. For example, in the embodiment shown in FIG. 5, it may be necessary to form additional slots 37 in the base 21 or use rails affixed to the base 21 in order to maintain the desired location of the support structure 35 with the arcuate base 36 in relation to the base 21.

Figure 9:
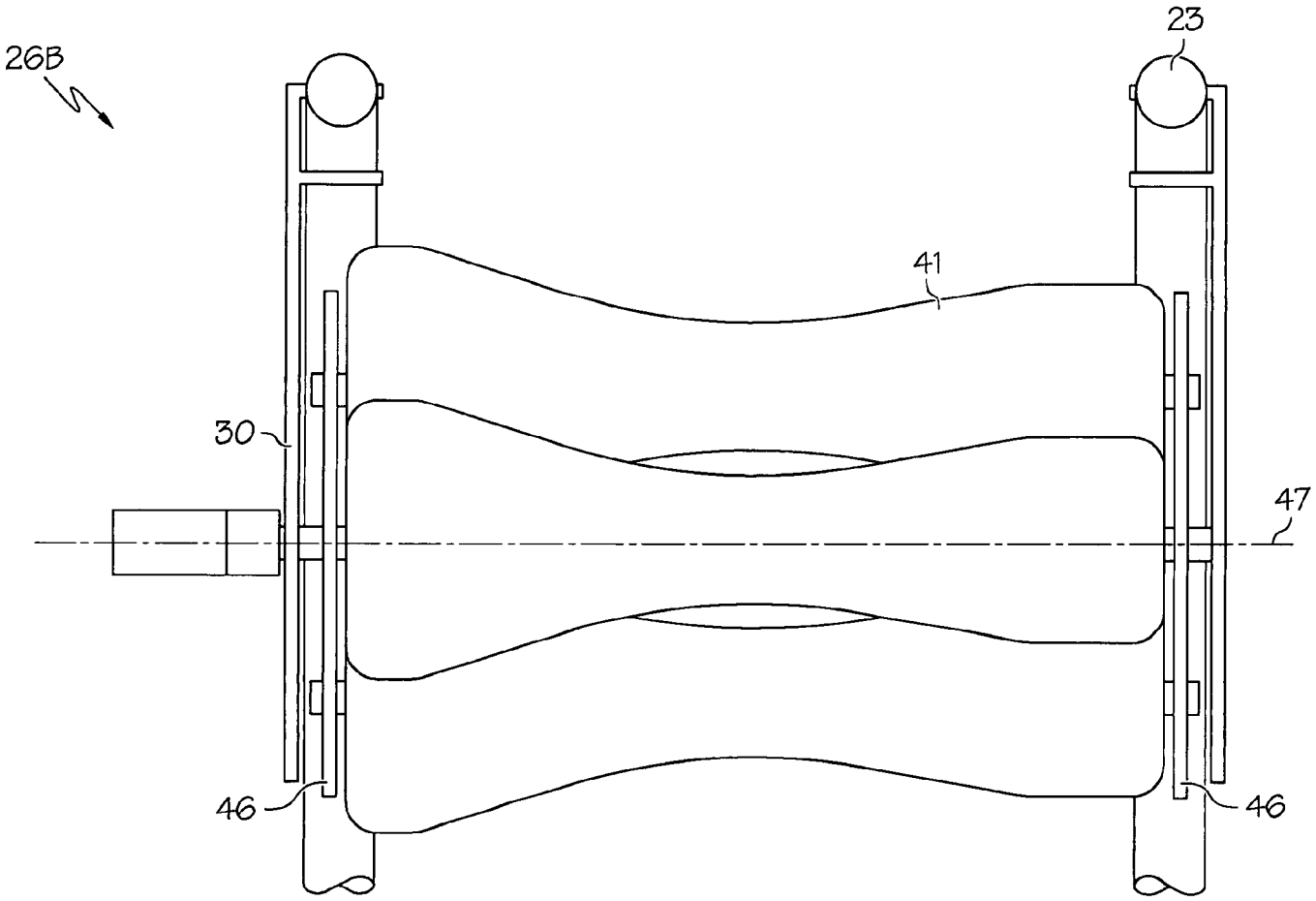
FIG. 9 is an enlarged fragmentary end view of a roller assembly, here a multiple roller unit, according to an embodiment of the present invention.

Another embodiment of the roller assembly 26 is the multiple roller unit 26B, as shown best in FIG. 9. The multiple roller unit 26B, consists primarily of two or more rollers 41 and hubs 46. Each roller 41 is positioned at an equal radial distance from the roller assembly's axis of rotation 47, extending generally from the center of one hub 46 to the center of another hub 46. The rollers 41 are positioned so that taken together the rollers 41 form a generally cylindrical shape. The roughly cylindrical positioning of the rollers 41 is advantageous in that, moved at a constant speed along the patient's limb, each roller 41 has equal and intermittent contact with the limb. This can afford a varying massage-like application of force to the limb. The number of rollers 41 in the multiple roller unit 26B depends on the desired periods of contact and non-contact and variations in pressure to the limb, to allow fluid into and press fluid out of the veins. Each roller 41 is free to rotate with respect to hubs 46. Thus, as the roller assembly 26 is rotated, each roller 41 passes over the patient's body in a rolling motion. As illustrated, one or more suspension structures 30 may attach to each of one or more hubs 46 and each suspension structure 30 may be moveably or fixedly attached to the one or more hinged frame rails 23. Alternatively, as previously discussed, one or more support structures 35 may attach to each of one or more hubs 46 and each support structure 35 may be moveably or fixedly attached to the base 21. The one or more support structures 35 may be any structure for effectively positioning the roller assembly 26B in proximity to the one or more hinged frame rails 23 for contact with a patient's limb.

Figure 11:
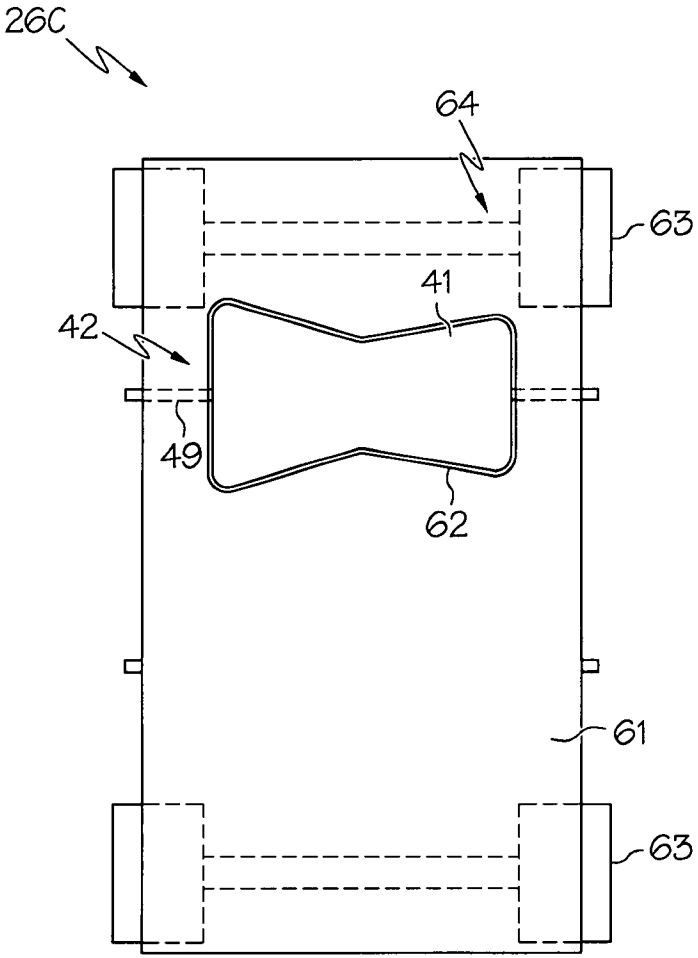
FIG. 11 is an enlarged top plan view of the belt and roller of the machine of FIG. 10.
Figure 12:
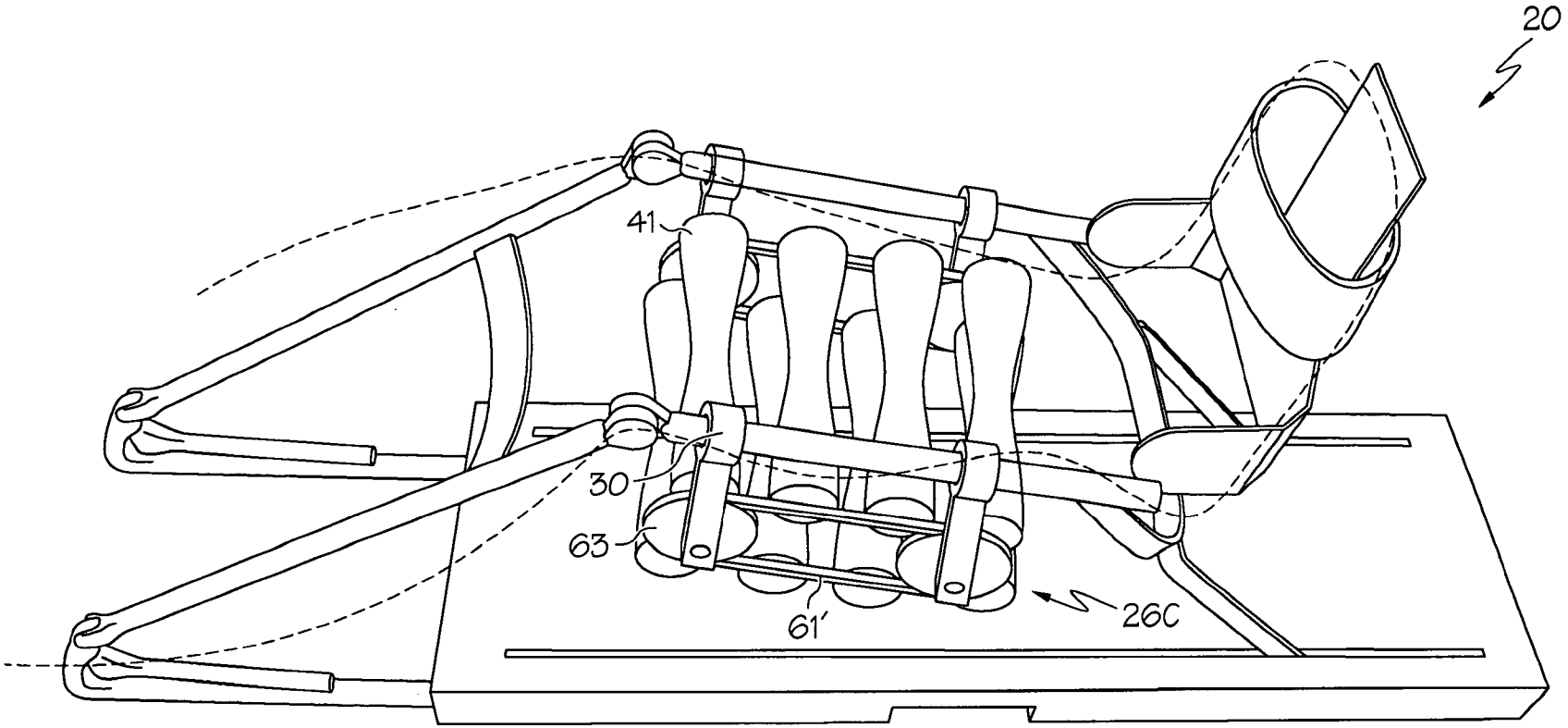
FIG. 12 is a perspective view of a CPM machine with integrated DVT prophylactic therapy having a roller assembly that is a belt and roller apparatus, according to still another embodiment of the invention.

Depicted in FIGS. 10, 11 and 12, the roller assembly 26 may be the belt and roller apparatus 26C. The belt and roller apparatus 26C of FIG. 10, includes a belt 61, one or more openings 62, one or more rollers 41 disposed within the openings 62, and multiple rolling end pieces 63 located at each end of the belt 61 to provide support and facilitate movement of the belt 61. The rollers 41 are supported rotatively by pins 49 or other fastening devices such that the rollers 41 can rotate freely with respect to the belt 61. The distance between the rolling end pieces 63 is determined according to the type of limb receiving therapy and the desired distance of translation of the rollers 41 across the limb. The further embodiment of the belt and roller apparatus 26C depicted in FIG. 12 includes multiple belts 61' and one or more rollers 41 disposed between the belts 61'.

It is desired that the rollers 41 and not a surface of the belt 61 or 61' be brought into contact with a patient. Thus as shown in FIG. 11, the belt 61 is connected with rollers 41 so that the outer surface of each roller 41 extends out well beyond the belt's outward facing surface. And here, for example, the pins 49 or other fastener are secured to the belt and pass through a central bore 42 of each roller 41.

The belt 61 moves the rollers 41 from a distal position to a relatively proximal position on the patient's limb. As each roller 41 rolls against the patient's limb it creates directional pressure, thereby moving blood and fluid from the distal end of the limb towards the torso. The belt and roller apparatus 26C is oblong or elliptical in profile with dimensions further selected such that the belt and roller apparatus 26C does not interfere with movement of the one or more hinged frame rails 23 during movement of the patient's limb. To enable passage of the rollers, the rolling end pieces 63 can be individual spaced apart wheel-like pieces arranged at edge of the belt with enough space between them to allow passage of the rollers 41, or as shown in FIG. 11, the pieces 63 may have a large central groove 64 of sufficient width to permit passage of the rollers 41. As with the other embodiments of the roller assembly 26, described above, the belt and roller apparatus 26C may be suspended from the one or more hinged frame rails 23 by one or more suspension structures 30 or the belt and roller apparatus 26C may be supported by one or more support structures 35 secured to the base 21.

With respect to each of the above described embodiments, a rotational motion may be imparted to the roller assembly 26 during use. Such rotational motion is advantageous in that it moves the one or more rollers 41 against the area to be treated thereby imparting directional mechanical DVT prophylaxis. In a preferred embodiment, rotation is imparted to the roller assembly 26 such that the entire assembly rotates in a direction that presses fluid from the distal end of the limb towards the torso. As shown in FIG. 3, imparting rotation to the roller assembly 26 from the motor 27 is by a drive that can be any of a gear drive, a belt drive, a direct drive, or a transmission. Significantly less practical, although still within the inventive concept, a hand crank may be used as the drive to impart rotation to the roller assembly 26.

Figure 14:
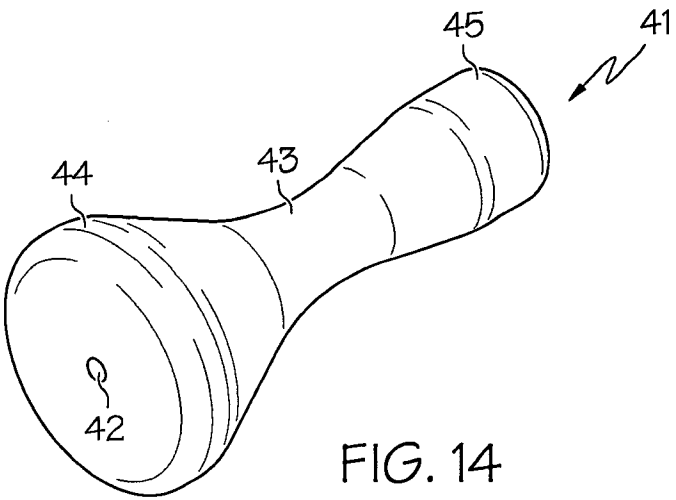
FIG. 14 is an enlarged perspective view of a roller with an asymmetric contour, for use in the CPM machine with integrated DVT prophylactic therapy.
Figure 13:
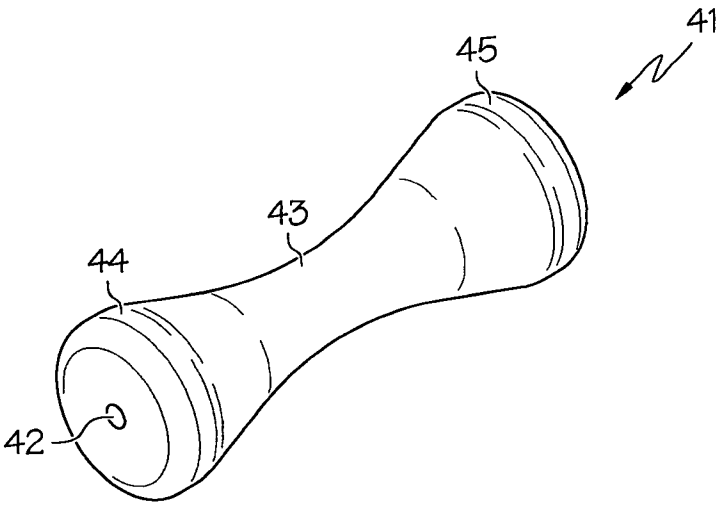
FIG. 13 is an enlarged perspective view of a roller with a symmetric contour, for use in the CPM machine with integrated DVT prophylactic therapy.

Each of the above described embodiments includes one or more rollers 41. Although the rollers 41 may be of any material, they are preferably of material that is soft enough to be comfortable to the patient, but firm enough to cause the desired tissue compression. Further, the profile or contour of each roller 41 may take a variety of shapes. In one embodiment, the roller 41 has a symmetric contour, wherein a mid portion 43 of the roller 41 is smaller in diameter than the ends, 44 and 45, as illustrated in FIG. 13. This shape is advantageous in that the patient's leg tends to be centered toward the mid portion 43 of the roller 41 when the roller assembly 26 is applied to the patient. In another embodiment, shown for example in FIG. 14, a roller 41 has an asymmetrical contour. In this particular asymmetrical contour, a first end 44 of the roller 41 has a larger diameter than a second end 45. In the illustrated embodiment the narrow mid portion 43 of the roller 41 is still positioned generally at a central position between the first and second ends, 44 and 45, of the roller 41; however from the mid portion 43 to the first end 44 the contour of the roller differs from the contour from the mid portion 43 to the second end 45. Such an asymmetrical contour can be beneficial for applying increased or decreased compression to specific vascular structures. It is believed, for example, that such an asymmetrical contour allows an individual roller 41 to focus pressure on the medial side of the calf, the portion of the patient's leg where vascular structures are most concentrated.

It is further noted that each roller 41, whatever its contour, may also be configured so as to have structures 52 on its surface such as bumps, ridges, or other configurations. The roller of FIG. 4 shows one such structured surface 52. These structures may further assist in providing prophylactic massage to a patient.

According to a further embodiment, the device 20 includes a vascular monitoring system forming a feedback loop in control or partial control of the motor. One such monitoring system is a commercially available Doppler ultrasound monitor 56 shown schematically in FIG. 3. Other technologies capable of detecting venous blood flow velocity could be used in lieu of Doppler ultrasound. In practice, the monitoring system 56 is used on the patient in known manner, to monitor the patient's blood flow at a position affected by the prophylactic roller assembly 26. The patient's blood flow velocity at the desired location is detected by the Doppler system. The velocity information is used as feedback data to alter either the pressure applied by the rollers 41 or the velocity of rotation of the roller assembly 26, in order to achieve the desired blood flow velocity. The vascular monitoring system includes the monitor, an element for transmitting data (such as a data wire), and a controller. The controller may include programming and connection to other control mechanisms that affect pressure and/or rotation of the roller assembly 26.

In yet a further embodiment, the one or more limb supports 25 comprise the sling 43 shown in FIG. 3. Although any fabric or other material capable of supporting a limb is within the inventive concept, preferably the sling 43 is comprised of or lined with a material such as lambs wool or neoprene. The sling 43 prevents direct contact between the patient's skin and the roller 41 of the device 20, and serves to limit abrasion of the skin. The sling 43 is preferably held in a generally constant position with respect to the patient's body such that the sling 43 is not moved by rotation of the roller assembly 26.

The CPM machine with integrated DVT prophylactic therapy 20 operates to provide simultaneous continuous passive motion and mechanical DVT prophylaxis to a patient. A typical patient, such as an individual recovering from a total knee replacement, lies on a floor, bed or other surface in a supine position. The machine 20 is positioned with respect to the patient, such that the patient's limb rests atop the one or more limb supports 25. The device 20 is adjusted or otherwise manipulated so as to bring roller assembly 26 into contact with a patient's leg. The patient's leg can be secured to the one or more hinged frame rails 23 of the device 20. Operation of the device causes passive motion of the patient's limb and joint through a predetermined range of motion. Further, operation imparts a turning motion to the roller assembly 26, such that one or more rollers 41 move across the patient's limb. The rollers 41 partially compress the patient's tissues and assist in moving blood through the tissues, and particularly the deep veins. The roller assembly 26 may be positioned and manipulated so as to rotate in either a clockwise or a counterclockwise direction. The preferred direction or rotation causes the rollers 41 to translate from a distal position to a relatively proximal position, in order to encourage movement of blood and fluid from the distal end of the extremity towards the torso.

The above described embodiments provide significant advantages over the devices, methods and therapies found in the prior art. First, the present invention provides more effective mechanical DVT prophylaxis than is provided by the devices and methods found in the prior art. Specifically, the above-described device provides directional compression, which effectively aides the movement of blood and other fluids from the distal end of the limb towards the torso. Second, the present invention is portable and simple to use in the same ways that prior art CPM devices are known to be portable and simple to use. Accordingly, doctors will likely use and prescribe the present invention in the same manner that they have long prescribed inpatient and outpatient use of a CPM machine for post-operative therapy. Further, doctors will enjoy enhanced peace-of-mind knowing that patients are undergoing safe and effective DVT prophylaxis during the period of highest risk for DVT formation. Third, the present invention is practical and cost effective for a majority of patients, as Medicare covers the at-home use of a CPM device.

Finally, this combination of two therapies is significantly more than the sum of its parts. The simultaneous provision of CPM and DVT prophylaxis will likely provide enhanced and synergistic effects. For example, it has been shown that CPM of the lower limb alone creates enhanced venous flow which serves to decrease risk of DVT formation. It follows logically that the simultaneous provision of CPM and mechanical DVT prophylaxis maximizes venous flow and further minimizes risk of DVT formation in an otherwise sedentary post-operative patient. Further, it is likely that maximum venous flow will have the additional effect of reducing swelling in the limb, as enhanced circulation draws excess fluid from the soft tissue by osmosis. Conversely, healing damaged tissue and fighting infection at the site of an incision, such as that made during joint replacement surgery, involves a complex cellular inflammatory response that includes white blood cells, platelets, and a variety of other cells and proteins that travel in the blood. Accordingly, increased blood flow to the damaged tissues further promotes wound healing and fighting infection. Moreover, increased blood supply may help prevent formation of excess scar tissue.

While the invention has been described with reference to a preferred embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

What is claimed is:

1. A machine for providing simultaneous passive motion therapy and deep vein thrombosis prophylactic therapy to a leg of a human patient, comprising;

a base;

one or more hinged frame rails operatively coupled to the base, each hinged frame rail having a hinge, the one or more hinged frame rails being configured for reciprocal movement through a range of motion relative to the base such that each hinged frame rail pivots about its hinge between a first position and a second position;

one or more limb supports connected to the one or more hinged frame rails, wherein the one or more limb supports are configured to support the leg of the patient such that the knee of the leg of the patient is positioned proximate the hinges of the one or more hinged frame rails, wherein the first position of the one or more hinged frame rails corresponds to a bent position of the knee of the patient, and wherein the second position of the one or more hinged frame rails corresponds to a straight position of the knee of the patient;

a roller assembly rotatably coupled to the one or more hinged frame rails, the roller assembly comprising one or more rollers; and one or more motors operatively coupled to the one or more hinged frame rails, the one or more motors being configured to effect reciprocal movement of the one or more hinged frame rails through the range of motion such that the knee of the patient is flexed between the bent position and the straight position and the one or more rollers provide directional mechanical deep vein thrombosis prophylaxis to the leg of the patient.

2. The machine according to claim 1, wherein at least one of the one or more motors is operatively coupled to the roller assembly, and wherein the one or more motors are configured to impart rotational motion to the roller assembly.

3. The machine according to claim 1, wherein the one or more motors are operatively coupled to the roller assembly through one of a belt drive, a gear drive, a direct drive, and a crank.

4. The machine according to claim 1, wherein the one or more rollers have an asymmetrical contour.

5. The machine according to claim 1, wherein the one or more rollers define one or more surface structures.

6. The machine according to claim 1, wherein the one or more limb supports comprise a sling.

7. The machine according to claim 1, further comprising a vascular monitor system positioned in operative communication with the one or more motors.

8. The machine according to claim 7, wherein the vascular monitor system comprises a controller positioned in operative communication with the one or more motors, wherein the controller is configured to provide feedback to the one or more motors to thereby control one or more operating parameters of the roller assembly.

9. The machine according to claim 1, wherein the roller assembly comprises a single roller.

10. The machine according to claim 9, further comprising one or more suspension structures coupled to the one or more hinged frame rails and configured for attachment to the single roller, wherein the single roller is configured to rotate relative to the one or more suspension structures.

11. The machine according to claim 10, wherein the one or more suspension structures further comprise a spring configured to bias the roller toward the leg of the patient.

12. The machine according to claim 9, further comprising one or more support structures supported on the base, wherein the single roller is secured to the one or more support structures, and wherein the single roller is configured to move with respect to the one or more support structures.

13. The machine according to claim 1, wherein the roller assembly further comprises a belt and roller apparatus, the belt and roller apparatus comprising a belt, one or more rollers, and one or more rolling end pieces, the one or more rollers of the roller assembly being disposed within the belt, the one or more rolling end pieces being configured to facilitate movement of the belt.

14. The machine according to claim 13, further comprising one or more suspension structures secured to the one or more hinged frame rails, wherein the belt and roller apparatus is secured to the one or more suspension structures.

15. The machine according to claim 13, further comprising one or more support structures supported on the base, wherein the belt and roller apparatus is secured to the one or more support structures.

16. A passive motion machine for providing both passive movement and deep vein thrombosis prophylaxis to a leg of a human patient, comprising:

at least one hinged frame rail configured to support the leg of the patient, each hinged frame rail having a hinge, the at least one hinged frame rail being further configured for reciprocal movement through a range of motion such that each hinged frame rail pivots about its hinge between a first position and a second position;

at least one limb support connected to the at least one hinged frame rail, wherein the at least one limb support is configured to support the leg of the patient such that the knee of the leg of the patient is positioned proximate the hinges of the at least one hinged frame rail, wherein the first position of the at least one hinged frame rail corresponds to a bent position of the knee of the patient, and wherein the second position of the at least one hinged frame rail corresponds to a straight position of the knee of the patient;

at least one suspension structure coupled to the at least one hinged frame rail;

a roller assembly connected to the at least one suspension structure such that the roller assembly is configured for rotation relative to the at least one suspension structure; and wherein, during rotation of the roller assembly and reciprocal movement of the at least one hinged frame through the range of motion, the knee of the patient is flexed between the bent position and the straight position to provide passive movement to the leg of the patient and contact between the roller assembly and the leg of the patient is configured to provide deep vein thrombosis prophylaxis to the leg of the patient.

17. The passive motion machine according to claim 16, further comprising a fabric limb support sling secured to the at least one frame rail and positioned between the leg of the patient and the roller assembly.

18. The passive motion machine according to claim 16, further comprising a means for rotating the roller assembly.

19. The passive motion machine according to claim 18, wherein the means for rotating the roller assembly comprises a motor and a driving element positioned between and operatively coupled to the motor and the roller assembly, the driving element being configured to transmit rotational energy from the motor to the roller assembly, wherein the driving element is selected from the group consisting of a gear drive, a belt drive, a direct drive, and a transmission.

20. The passive motion machine according to claim 18, further comprising:

a vascular monitor configured to monitor the venous flow of the patient; and a controller operatively coupled to the vascular monitor and the means for rotating the roller assembly, wherein the vascular monitor is configured to provide blood flow data to the controller.

21. The passive motion machine according to claim 16, wherein the roller assembly comprises a single roller, wherein the roller assembly has a center of rotation, wherein the single roller has a rotational axis, and wherein the rotational axis of the single roller is spaced from the center of rotation of the roller assembly.

22. A passive motion machine for providing deep vein thrombosis prophylactic therapy to a leg of a human patient comprising:

at least one hinged frame rail configured to support the leg of the patient, each hinged frame rail having a hinge, the at least one hinged frame rail being further configured for reciprocal movement through a range of motion such that each hinged frame rail pivots about its hinge between a first position and a second position;

at least one limb support connected to the at least one hinged frame rail, wherein the at least one limb support is configured to support the leg of the patient such that the knee of the leg of the patient is positioned proximate the hinges of the at least one hinged frame rail, wherein the first position of the at least one hinged frame rail corresponds to a bent position of the knee of the patient, and wherein the second position of the at least one hinged frame rail corresponds to a straight position of the knee of the patient;

first and second suspension structures coupled to the at least one hinged frame rail;

first and second hubs rotatably connected to the first and second suspension structures;

one or more rollers rotatably connected to the first and second hubs; and a means for rotating the one or more rollers, wherein, during rotation of the one or more rollers and reciprocal movement of the at least one hinged frame through the range of motion, the knee of the patient is flexed between the bent position and the straight position to provide passive movement to the leg of the patient and contact between the one or more rollers and the leg of the patient is configured to provide deep vein thrombosis prophylaxis to the leg of the patient.

23. The passive motion machine according to claim 22, wherein the means for rotating the one or more rollers comprises a motor and a drive element, the drive element selected from the group consisting of a gear drive, a belt drive, a direct drive and a transmission, wherein the drive element is configured to connect the motor to one or both of the first and second hubs.

24. The passive motion machine according to claim 22 further comprising:

a vascular monitor configured to monitor the blood flow of the patient; and a controller operatively coupled to the vascular monitor and the means for rotating the one or more rollers, wherein the vascular monitor is configured to provide blood flow data to the controller.

25. The passive motion machine according to claim 22, wherein each roller has an asymmetrical contour.

26. The passive motion machine according to claim 22, wherein the rollers further comprise one or more surface structures.

27. A machine for providing simultaneous passive motion therapy and deep vein thrombosis prophylactic therapy to a leg of a human patient, comprising;

a base;

one or more hinged frame rails operatively coupled to the base, each hinged frame rail having a hinge, the one or more hinged frame rails being configured for reciprocal movement through a range of motion relative to the base such that each hinged frame rail pivots about its hinge between a first position and a second position;

one or more limb supports connected to the one or more hinged frame rails, wherein the one or more limb supports are configured to support the leg of the patient such that the knee of the leg of the patient is positioned proximate the hinges of the one or more hinged frame rails, wherein the first position of the one or more hinged frame rails corresponds to a bent position of the knee of the patient, and wherein the second position of the one or more hinged frame rails corresponds to a straight position of the knee of the patient;

a roller assembly rotatably coupled to the one or more hinged frame rails, the roller assembly comprising one or more rollers;

one or more motors operatively coupled to the one or more hinged frame rails, the one or more motors being configured to effect reciprocal movement of the one or more hinged frame rails through the range of motion such that the knee of the patient is flexed between the bent position and the straight position and the one or more rollers provide directional mechanical deep vein thrombosis prophylaxis to the leg of the patient;

a vascular monitor configured to monitor the blood flow of the patient; and a controller operatively coupled to the vascular monitor and the one or more motors, wherein the vascular monitor is configured to provide blood flow data to the controller.

28. The machine according to claim 27, wherein the controller is configured to provide feedback to the one or more motors to thereby control one or more operating parameters of the roller assembly.

* * * * *